US007928845B1

(12) United States Patent
LaRosa

(10) Patent No.: US 7,928,845 B1
(45) Date of Patent: Apr. 19, 2011

(54) TOOL TRACKING APPARATUS

(76) Inventor: William A. LaRosa, Sea Isle City, NJ (US)

( * ) Notice: Subject to any disclaimer, the term of this patent is extended or adjusted under 35 U.S.C. 154(b) by 350 days.

(21) Appl. No.: 12/126,197

(22) Filed: May 23, 2008

(51) Int. Cl.
*G08B 13/14* (2006.01)
*G08B 21/00* (2006.01)

(52) U.S. Cl. ..... 340/572.1; 340/539.32; 340/539.21; 340/686.5; 340/686.6

(58) Field of Classification Search ..... 340/572.2, 340/572.1
See application file for complete search history.

(56) References Cited

U.S. PATENT DOCUMENTS

| | | | | |
|---|---|---|---|---|
| 4,733,633 | A * | 3/1988 | Yarnall et al. | 119/721 |
| 5,794,569 | A * | 8/1998 | Titus et al. | 119/721 |
| 7,042,361 | B2 * | 5/2006 | Kazdin et al. | 340/573.4 |
| 2004/0217864 | A1 * | 11/2004 | Nowak et al. | 340/572.1 |
| 2007/0152838 | A1 * | 7/2007 | Hsieh | 340/600 |

* cited by examiner

*Primary Examiner* — Donnie L Crosland

(57) ABSTRACT

A tool tracking apparatus constructed by a base monitoring station that has electronic circuitry, an LED display panel and an audible alarm; a power supply including a battery power backup for the base monitoring station; a perimeter loop wire electrically connected to the base monitoring system defining an extended area in which at least one tool is protected or can be located; at least one wireless security tag fixedly attached to the at least one tool for rounding a second audible alarm when the locate button on the base monitoring station is pushed or for triggering the first audible alarm when the at least one wireless security tag approaches the perimeter loop wire at a distance less than a preset distance.

5 Claims, 3 Drawing Sheets

TOOL TRACKING APPARATUS

FIELD OF THE INVENTION

The present invention generally relates to a monitoring and alarm device and more particularly, relates to a tool tracking apparatus for locating a hand tool or to prevent a security breach when a hand tool is being taken out of a monitored security area.

BACKGROUND OF THE INVENTION

Hand tools, especially power tools, are widely used on a construction site. Frequently, a power hand tool can be misplaced on a construction site, or a power hand tool can be stolen by an unauthorized person and removed from the construction site. Since most power hand tools are purchased at high cost, it would be desirable to be able to locate a misplaced hand tool on a construction site, or prevent the unauthorized removal of a hand power tool from construction sites.

It is therefore an object of the present invention to provide a tool tracking apparatus that can be activated to both locate a misplaced power hand tool and to prevent the unauthorized removal of such tool from a construction site.

SUMMARY OF THE INVENTION

In accordance with the present invention, a tool tracking apparatus for locating a misplaced power hand tool or to prevent the power hand tool being taken by unauthorized personnel out of a construction site is provided.

In a preferred embodiment, the present invention tool tracking apparatus is constructed of a base monitoring system that has a base monitoring station that has electronic circuitry, an LED display panel and an audible alarm; a power supply including a battery power backup for the base monitoring station; a perimeter loop wire electrically connected to the base monitoring system defining an extended area in which at least one tool is protected or can be located; at least one wireless security tag fixedly attached to the at least one tool for rounding a second audible alarm when the locate button on the base monitoring station is pushed or for triggering the first audible alarm when the at least one wireless security tag approaches the perimeter loop wire at a distance less than a preset distance.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a tool tracking apparatus that can be used to either locate a misplaced power hand tool on a job site, or to prevent the unauthorized removal of the power hand tool from the job site.

The present invention tool tracking apparatus is an electronic security system intended to locate missing tools or tools not put away at a work site after the end of a work shift. The security system uses a perimeter loop wire connected to a base monitoring station to define the secured area. The base station has an LED display and an onboard audible alert capability. The present invention can also have a secure means of powered operation along with a 12-volt backup battery for uninterrupted usage. The tracking apparatus secures the means of powering the base unit and can include a key-operated power switch or the inclusion of a ten-digit keypad for entering a secure access code. The wireless security tags can be affixed to high-value power tools with permanent adhesive backings. The security tags can be powered via watch battery with piezoelectric film transducers to generate a local audible alarm when the contractor depresses a locate button on the base unit. Any tool equipped with a wireless security tag can then be easily located by following the alarm sound to its source. A secondary function is its theft protection. In the theft prevention mode of operation, a tool equipped with a wireless security tag can have its audible tracking alarm activated when the tool came within a few feet of the perimeter loop wire. The base unit is then able to sense the field disturbance of the perimeter loop and activates its audible alarm tone when a tool equipped with a security tag came within close range.

The present invention tool tracking apparatus fulfills the need for a security system configured to meet the needs of the construction industry to locate lost or misplaced tools as well as to prevent tool theft. The appealing features of the present invention tool tracking apparatus are the use of the perimeter wire loop and base unit in combination with the individual tool security tags. The proposed security system can be turned on or off as needed to locate misplaced or forgotten tools as well as to provide a secure area for tool storage and use. The apparatus can be easily moved from one area to another at a job site to follow the progression of construction work while maintaining a necessary level of tool security.

Figure 1:
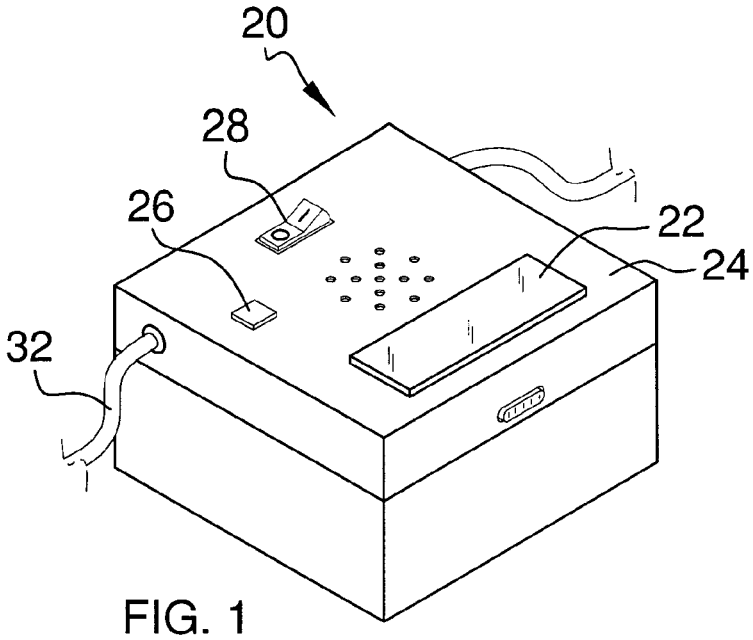
FIG. 1 is perspective view of the present invention base monitoring station for the tool tacking apparatus.
Figure 2:
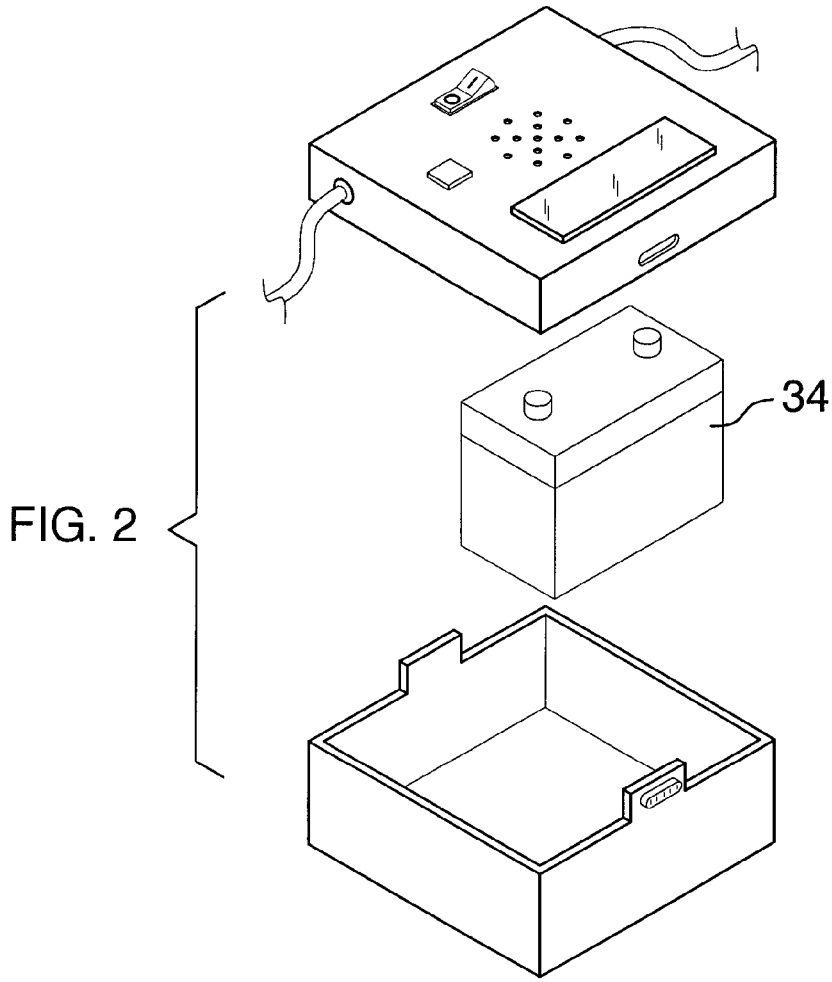
FIG. 2 is a perspective view of the present invention base monitoring station with the components separated.
Figure 5:
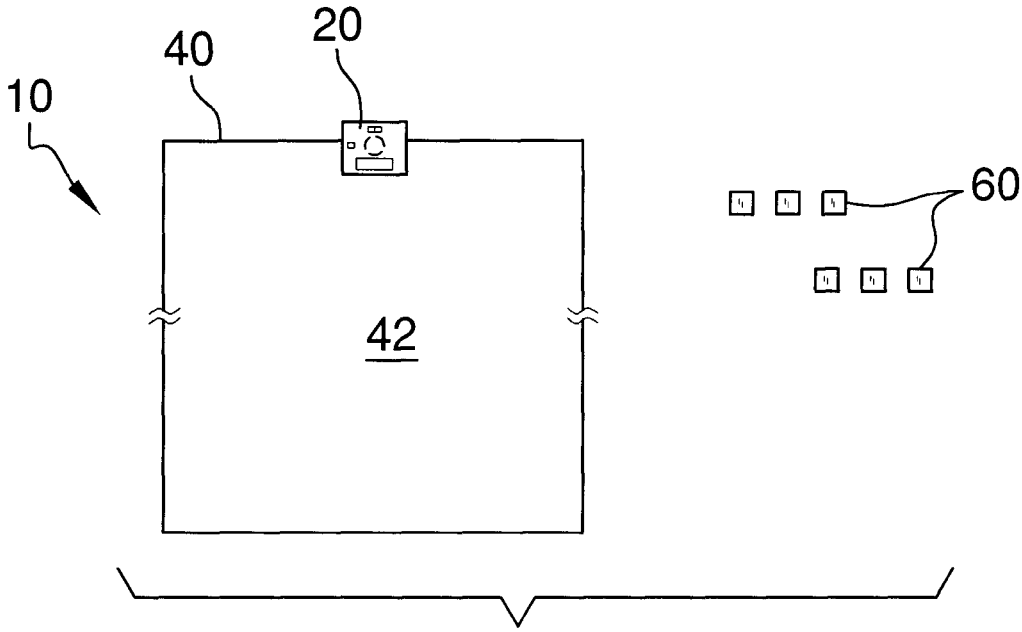
FIG. 5 is an illustration showing the lay out of the present invention tool tracking apparatus on a construction site.

Referring initially to FIG. 1, wherein a present invention base monitoring station 20 for the tool tracking apparatus 10 is shown in a perspective view. The tool tracking apparatus 10 is shown in FIG. 5. The base monitoring station 20, shown in FIGS. 1 and 2, has an electronic circuitry (not shown) inside the station, an LED display panel 22 on a top cover 24 of the station 20, a locate button 26, and a first audible alarm (not shown) inside the station 20. The base monitoring station 20 is further equipped with an on/off switch 28 for turning on or off the power supply to electronic circuitry and to the LED display panel 22.

A power supply through cable 32, which includes a battery power backup 34 is further provided on the base monitoring station 20 such that power supply is never interrupted even during a power blackout at the job site.

Figure 6:
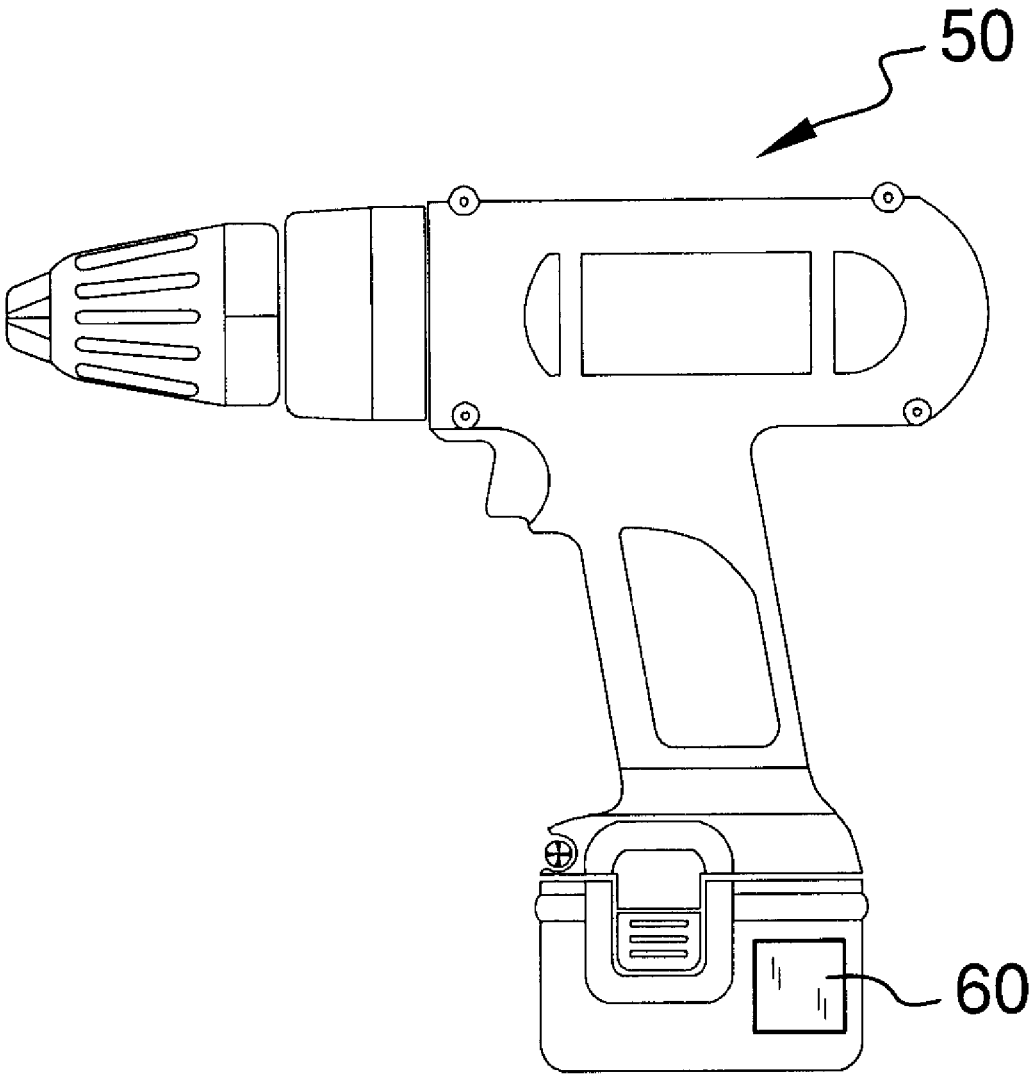
FIG. 6 is a front view of a power hand tool illustrating how the security tag is affixed to the tool.

A perimeter loop wire 40, as shown in FIG. 5, is electrically connected to the base monitoring system 20 defining an extended security area 42 in which at least one tool 50, shown in FIG. 6 is protected or can be located.

Figure 3:
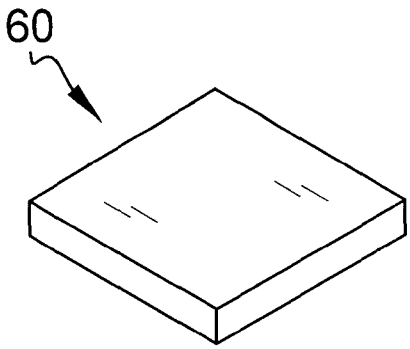
FIG. 3 is a perspective view of a wireless security tag for use in the present invention tool tracking apparatus.
Figure 4:
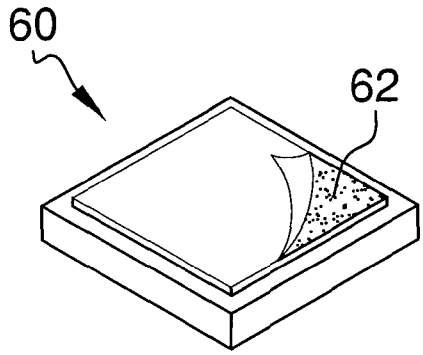
FIG. 4 is a back view of the present invention wireless security tag.

The present invention tool tracking apparatus 10 further includes at least one wireless security 60, shown in FIGS. 3,4 and 5*m*, that is fixedly attached to the at least one tool 50 by a permanent adhesive 62 for sounding an audible alarm when the locate button 26 on the base monitoring station 20 is pushed, or activated. The at least one wireless security tag 60 further triggers the audible alarm in the base monitoring station 20 when the wireless security 60 approaches the perimeter loop wire 40 at a distance less than a preset distance. The distance may be suitably selected, such as a distance between 5 and 10 feet. The wireless security tag 60 can be provided in a multiple number each attached to a power hand tool 50, such as that shown in FIG. 6.

The present invention tool tracking apparatus has therefore been amply described in the above descriptions and in the appended drawings of FIGS. 1-6.

While the preferred embodiments of the invention have been described above, it will be recognized and understood that various modifications can be made in the invention and the appended claims are intended to cover all such modifications which may fall within the spirit and scope of the invention.

What is claimed is:

1. A tool tracking apparatus comprising:

a base monitoring station having electronic circuitry, an LED display panel an audible alarm, and a locate button;

a power supply including a battery power backup for said base monitoring station;

a perimeter loop wire electrically connected to said base monitoring system defining an extended area in which at least one tool is protected or can be located;

at least one wireless security tag each equipped with a second audible alarm fixedly attached to said at least one tool for sounding said second audible alarm when said locate button on said base monitoring station is pushed or for triggering said first audible alarm when said at least one wireless security tag approaches said perimeter loop wire at a distance less than a preset distance.

2. The tool tracking apparatus according to claim 1, wherein said wireless security tag further comprising a battery for powering the tag.

3. The tool tracking apparatus according to claim 1, wherein said wireless security tag further comprising a piezoelectric film transducer for generating an audible alarm.

4. The tool tracking apparatus according to claim 1, wherein said perimeter loop wire defines an extended area that is at least 20 feet by 20 feet.

5. The tool tracking apparatus according to claim 1, wherein said locate button further comprising a plurality of buttons each assigned to a corresponding wireless security tag mounted on a corresponding power hand tool.

* * * * *